US005417031A

United States Patent [19]

Bankuty et al.

[11] Patent Number: 5,417,031

[45] Date of Patent: May 23, 1995

[54] APPARATUS FOR ROTATING CYLINDRICAL CAPS ONTO CONTAINERS

[75] Inventors: Geza E. Bankuty; Nicholas J. Perazzo, both of Bradenton, Fla.

[73] Assignee: New England Machinery, Inc., Bradenton, Fla.

[21] Appl. No.: 112,109

[22] Filed: Aug. 26, 1993

[51] Int. Cl.[6] ..... B67B 3/20; B65B 7/28

[52] U.S. Cl. ..... 53/331.5

[58] Field of Search ..... 53/306, 308, 317, 331.5, 53/368

[56] References Cited

U.S. PATENT DOCUMENTS

| | | | |
|---|---|---|---|
| 2,026,118 | 12/1935 | Barnby | 53/331.5 |
| 2,356,893 | 8/1944 | Shomperlen | 53/317 |
| 3,073,090 | 1/1963 | Roberts et al. | 53/317 X |
| 3,184,897 | 5/1965 | Shriner et al. | 53/331.5 |

OTHER PUBLICATIONS

Two (2) page Drawings for a New England Machinery Rotary Chuck Capper Model No.: NER CC-8 that existed prior to 1992.

*Primary Examiner*—Horace M. Culver

*Attorney, Agent, or Firm*—Pettis & McDonald

[57] ABSTRACT

This invention relates to an apparatus for rotating cylindrical downwardly facing threaded caps onto upwardly facing, threaded open ends of containers primarily for use in container capping machines. The apparatus comprises at least one spindle assembly slideably carried by a support frame for movement generally parallel to the vertical axis of the spindle assembly, the weight of the spindle assembly causing the downward movement of the spindle assembly, structure carried by the support frame for controlling the vertical movement of the spindle assembly, and a selectively adjustable device for resiliently urging the spindle assembly upwardly so that the device at least partially supports the weight of the spindle assembly and the container is engaged by a cap with less than the full weight of the spindle assembly pressing downwardly on the container.

6 Claims, 7 Drawing Sheets

APPARATUS FOR ROTATING CYLINDRICAL CAPS ONTO CONTAINERS

BACKGROUND OF THE INVENTION

1. Field of the Invention

The present invention relates to container capping machines. The invention is directed to an improved apparatus for placing caps into contact with their containers and rotating the caps onto the containers.

2. Description of the Prior Art

Bottle capping machines using the current art have been existence for over 20 years. An example of apparatus disclosing the state of the prior art is applicant's rotary chuck capper, Model No. NERCC-8 (prior to 1992). Prior art technology teaches the advancement of a container along a predetermined path until it is aligned with a spindle assembly of a capping machine. A cam follower is connected to the spindle so that as the cam follower moves along a cam having a varying elevation the spindle assembly moves up and down along a vertical axis as directed by the cam and cam follower. A compression spring applies a downward force to the spindle assembly, adding to the downward force caused by the weight of the spindle assembly, to ensure that the cam follower rides snugly on the cam. The bottom end of the spindle is attached to a collet housing to which is attached a collet. The collet captures a container cap for application to a container. When the generally vertical axis of the container becomes aligned with the generally vertical axis of the cap, the elevation of the cam decreases and the cam follower moves downwardly on the cam. This causes the spindle to move downwardly so that the cap engages the open end of the container. The weight of the spindle assembly plus the downward force provided by the compression spring causes the threads of the cap to push downwardly on the threads of the container. This downward force is difficult to control and often causes damage to the container threads, such as cross threading, stripping of the threads and collapse of the open end of fragile containers. Attempts were made to solve the problem by mounting a compression spring to the spindle assembly to apply an upward force to counteract the downward force caused by the first compression spring and the weight of the spindle assembly. This has not been entirely successful as damage to the containers and to the container threads still occurs. The springs do not apply a uniform force during their extension or compression as the spindle assembly moves downwardly to position the cap on the container and during the rotation of the cap onto the threads of the container frequently creating too much downward force. Selective adjustment of the tension or compression forces in the springs to close tolerances is difficult if not impossible. Therefore it is clear that there is a need for an apparatus that will apply a constant, light, downward force on the spindle throughout its movement. The apparatus must be selectively adjustable to allow light engagement of the cap and container threads and to provide light contact between the threads during rotation of the cap. This apparatus should also allow for quick adjustment when switching to production runs for containers and caps of different sizes and with different numbers of threads per inch. The apparatus should also be adaptable for easy exchange of collets for gripping the different sized caps.

A container capping machine having this improvement will be more efficient by reducing the number of damaged products, reducing the down time for change over, and reducing the number of work stoppages due to damaged products. Such an improvement will also provide the capability of using containers that have thin, flexible or fragile walls adjacent the container mouth.

SUMMARY OF THE INVENTION

The present invention is related to an apparatus for placing caps on containers and rotating the caps for engagement with the container. Such apparatus may be used with any capping machine utilizing a spindle assembly in the capping operation. One embodiment of this apparatus is disclosed in this application in used in conjunction with configurations other than rotary continuous motion cappers including intermittent in-line cappers or any other typical arrangement of a single spindle assembly or a plurality of spindle assemblies.

The apparatus for placing and rotating cylindrical, downwardly facing threaded caps onto an upwardly facing, threaded open end of a container comprises a support frame with at least one spindle assembly, having a generally vertical axis, being slidably carried by the support frame. The spindle assembly moves generally parallel to the vertical axis of the spindle assembly. The spindle assembly includes a collet that captures a cap, which has a generally vertical axis, for placement on a container.

The apparatus further comprises a means positioned adjacent to the support frame for advancing a container along a predetermined path until the generally vertical axis of the container is generally aligned with the axis of the spindle assembly. When a cap is captured by the collet, the cap's vertical axis is generally aligned with the vertical axis of the spindle; therefore, the vertical axis of the cap is aligned with the vertical axis of the container.

The apparatus further comprises a means for controlling the vertical movement of the spindle assembly to coordinate that movement with the movement of the container so that a cap captured by the collet may be brought downwardly into engagement with the open end of the container. The weight of the spindle assembly urges downward movement of the spindle assembly in relation to the support frame. A selectively adjustable biasing means is carried by the support frame to resiliently urge the spindle assembly in an upward direction generally parallel to the spindle axis. The upward force of the biasing means at least partially counterbalances the weight of the spindle assembly so that the container is engaged by the cap with less than the full weight of the spindle assembly being applied thereon.

The apparatus further comprises means for rotating the collet after the cap is brought into engagement with the container so that the cap may be threadably engaged to the open threaded end of the container.

BRIEF DESCRIPTION OF THE DRAWINGS

A preferred embodiment of the apparatus of this invention will be disclosed in detail below in connection with the drawings in which.

DESCRIPTION OF A PREFERRED EMBODIMENT

Figure 1:
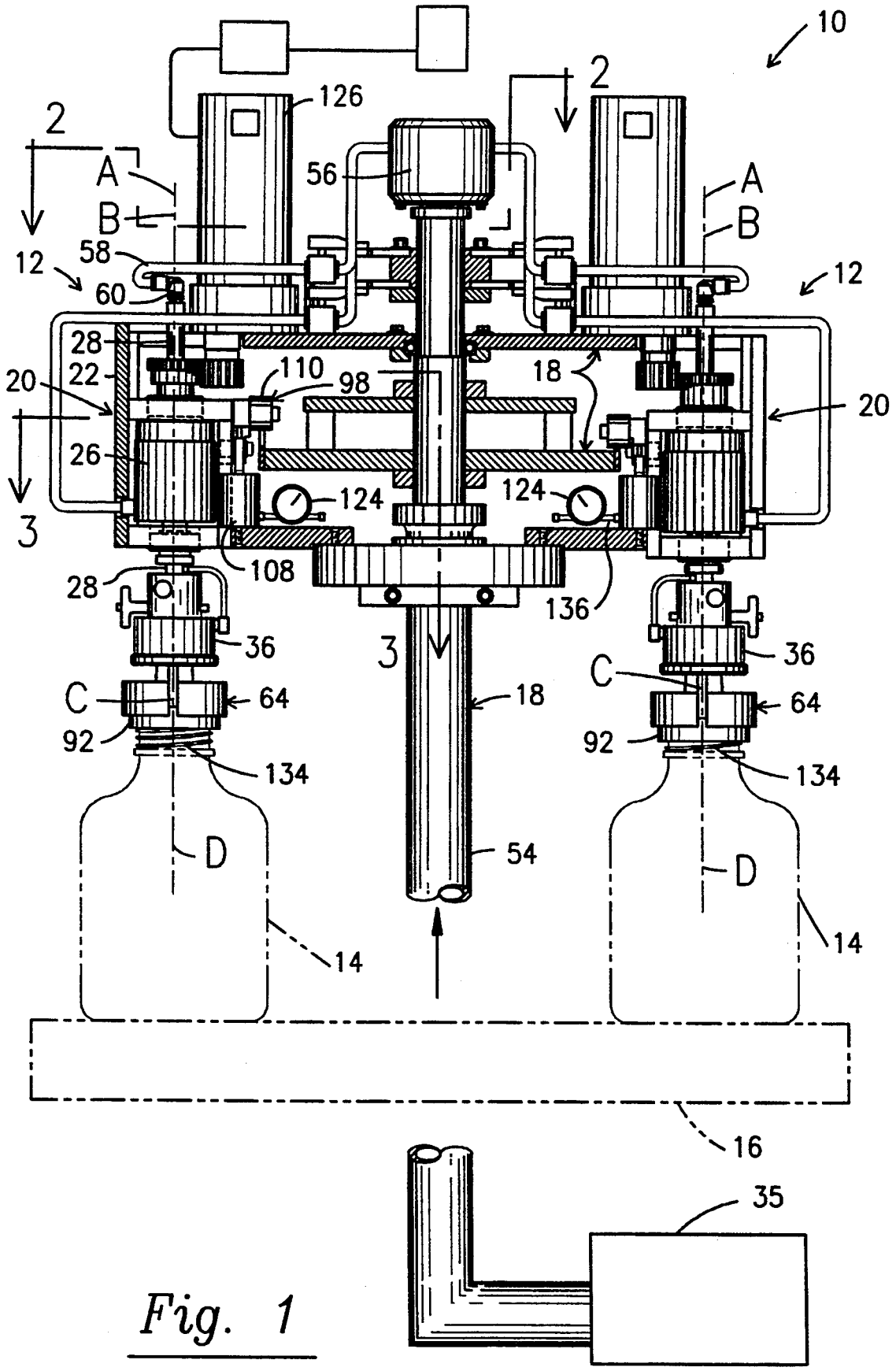
FIG. 1 is a fragmentary sectional view of a rotary chuck capping machine illustrating the apparatus of this invention incorporated as a portion thereof.
Figure 2:
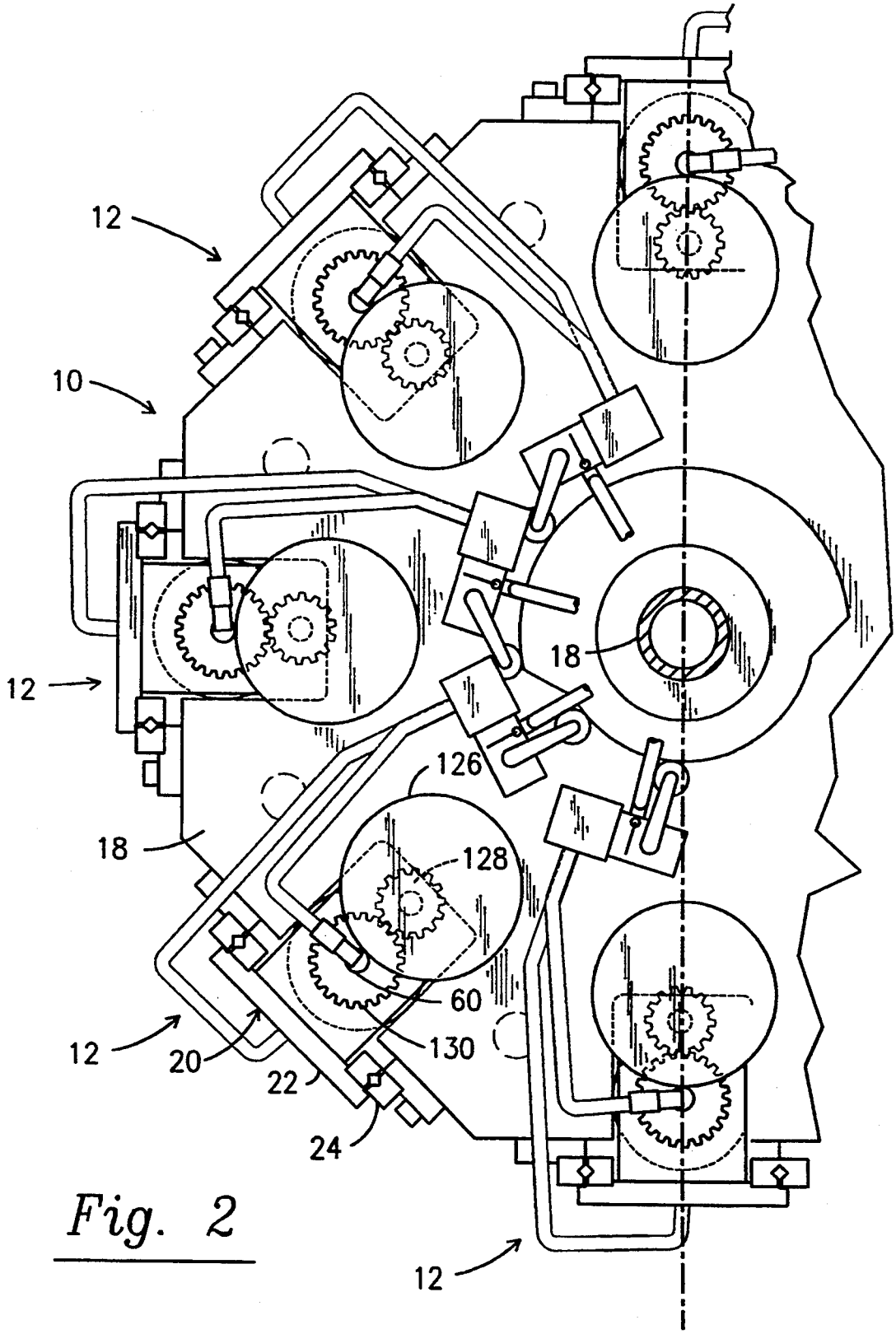
FIG. 2 is a cross sectional view of the rotary chuck capping machine of FIG. 1 taken along line 2—2 of FIG. 1, illustrating four stations plus a portion of a fifth station, each containing the apparatus of this invention.
Figure 3:
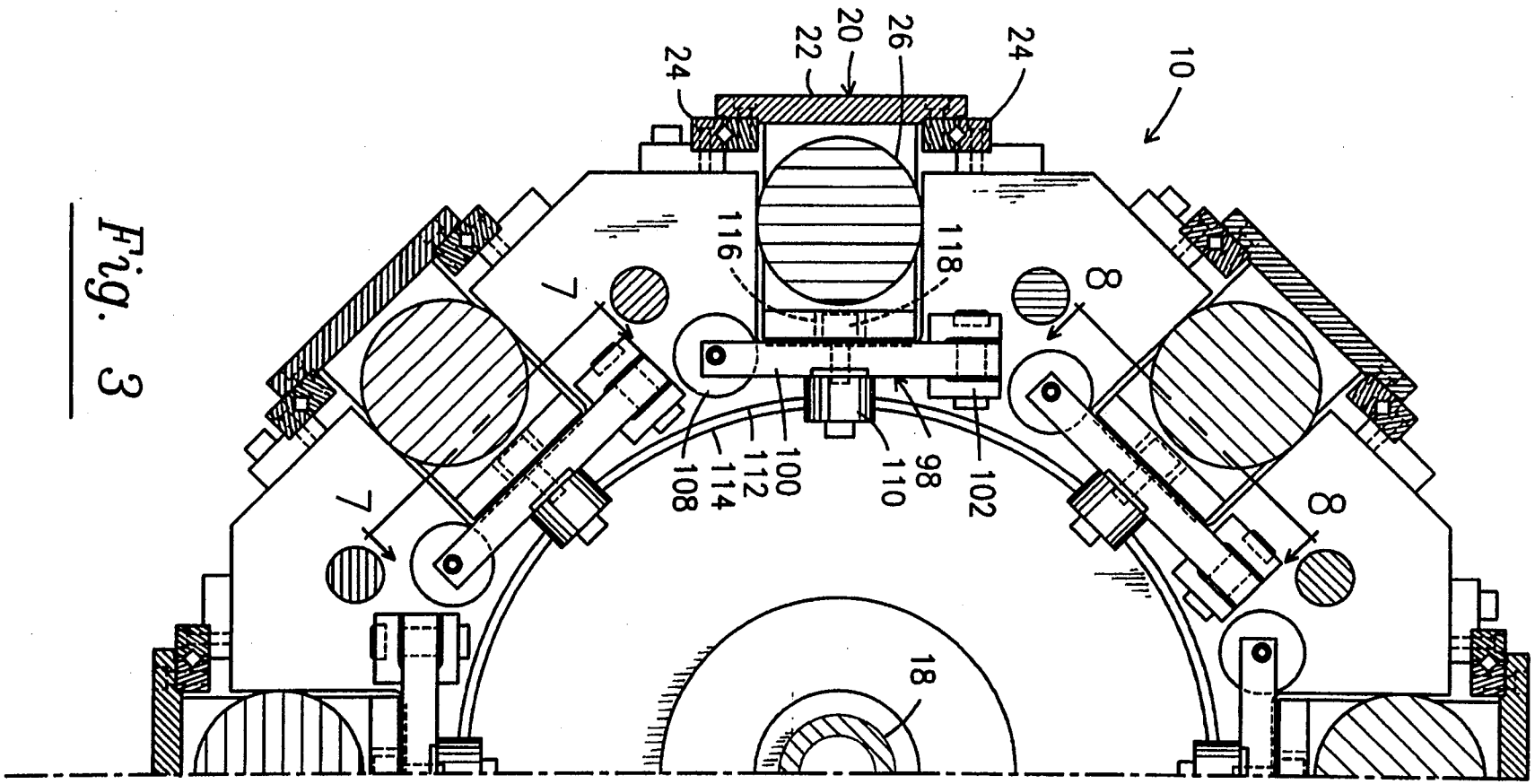
FIG. 3 is a top cross section view of the rotary chuck capping machine taken along line 3—3 of FIG. 1.

An embodiment of the apparatus of this invention is illustrated in FIGS. 1–8 in relationship to a rotary chuck capping machine that comprises a turret assembly 10 having eight stations, four and a portion of a fifth being shown in FIG. 2 and indicated generally as 12. In FIG. 1 a means for advancing containers 14 (shown in phantom) is illustrated schematically in phantom as 16. Such equipment is well known in the art; for example, the applicants' rotary base 6947-00-00D may be used in conjunction with the turret assembly 10. The apparatus of this invention is illustrated as being used with an eight station rotary chuck capping machine; however, the apparatus of this invention may be used with capping machines having a single or any number of stations. The stations do not necessarily have to be arranged in rotary fashion, they may be in line, side by side or in any reasonable configuration. Therefore, it is solely for illustrative purposes that a preferred embodiment is illustrated incorporated in an eight station rotary chuck capping machine.

Two stations 12 of the turret assembly 10 are illustrated in FIG. 1. The apparatus for rotating threaded caps onto the threaded open ends of containers is comprised in each station 12 and is more clearly seen in FIG. 4 that illustrates a single station at larger scale. This apparatus comprises a support frame 18 that is connected to or mounted on a floor (not shown). At least one spindle assembly, shown generally as 20, is carried by the support frame 18 for slidable movement that is generally parallel to a vertical axis A extending longitudinally through the spindle assembly 20.

Figure 4:
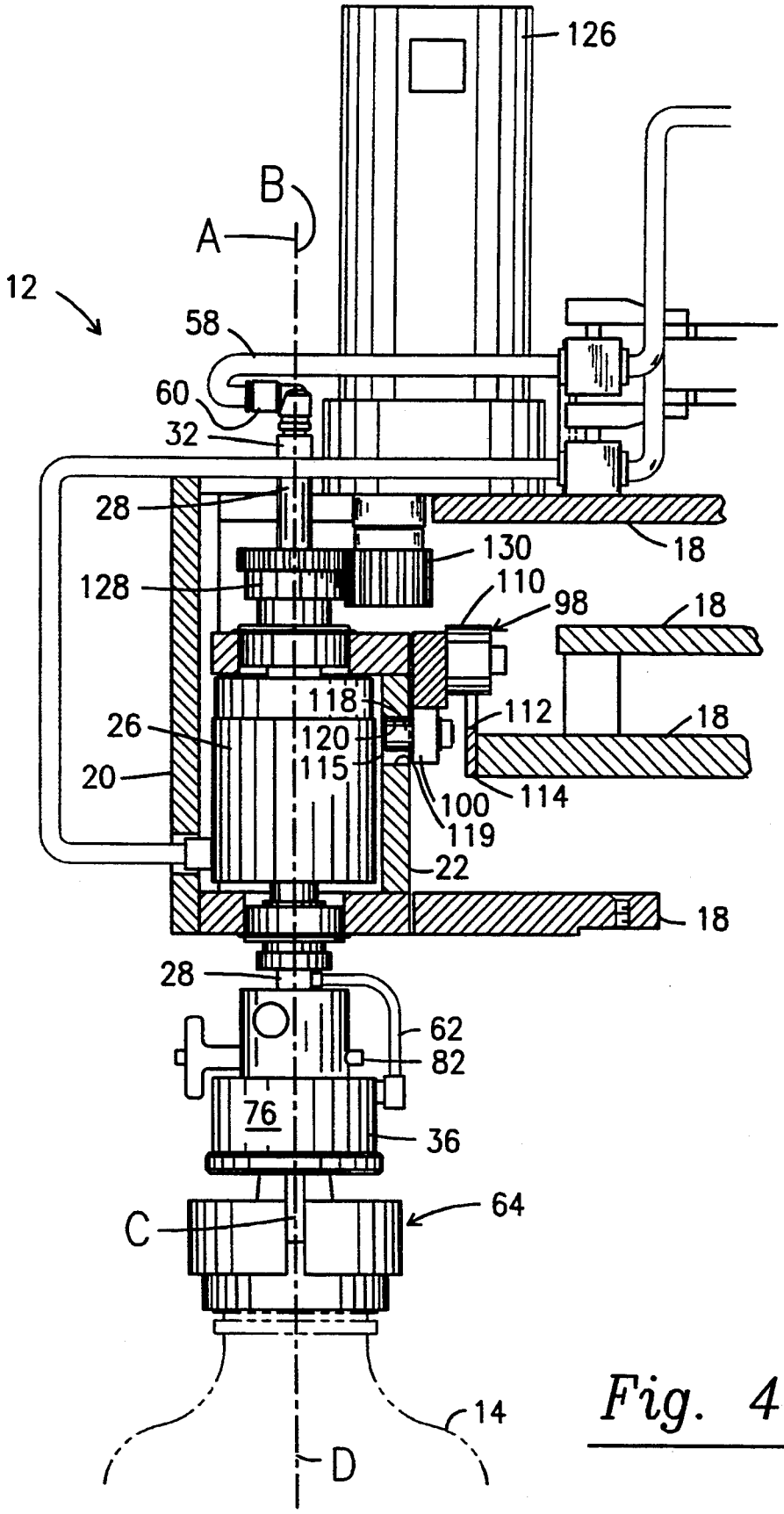
FIG. 4 is a detailed view of FIG. 1 shown at larger scale, illustrating a single station.
Figure 5:
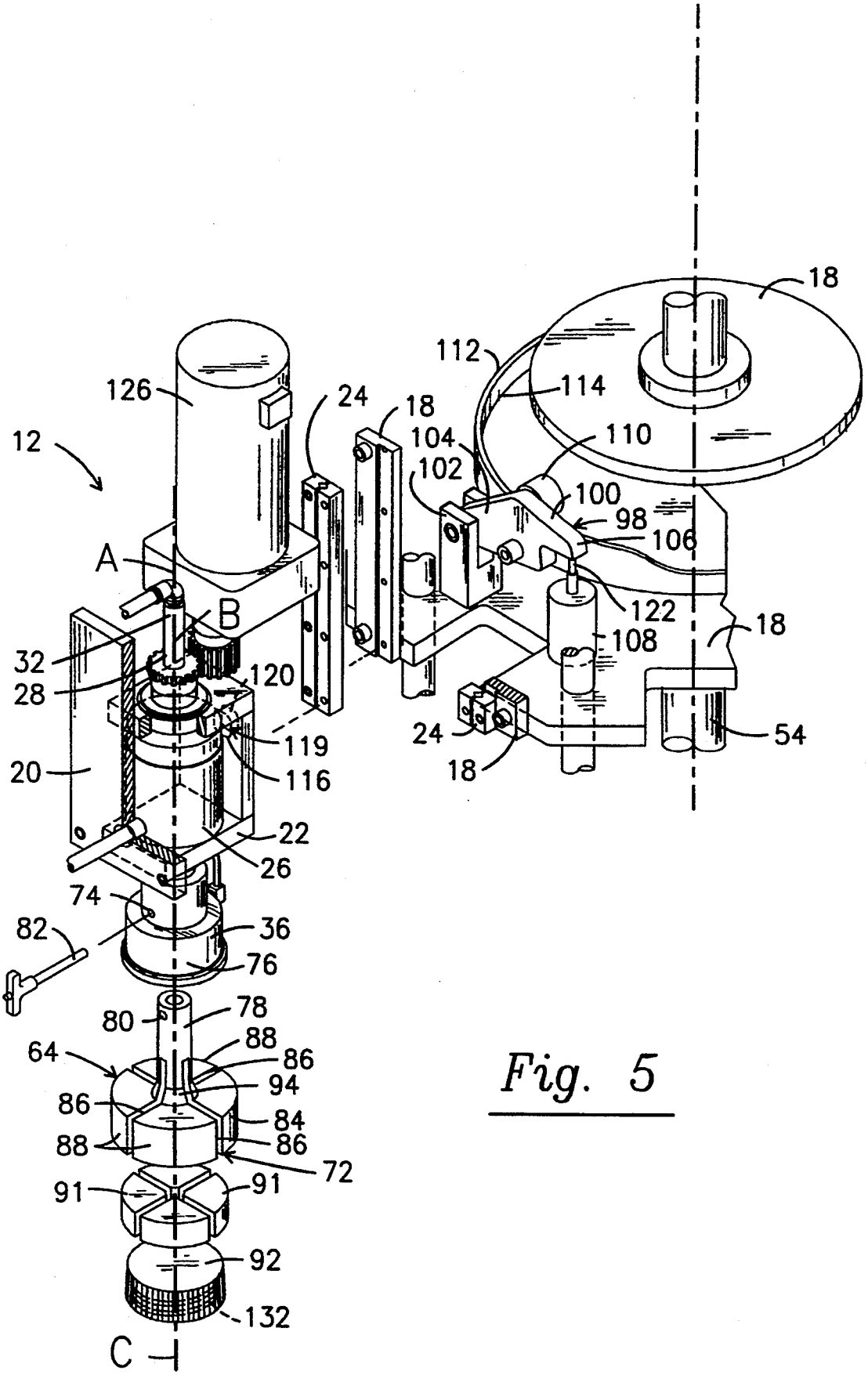
FIG. 5 is an exploded isometric view of FIG. 4.
Figure 6:
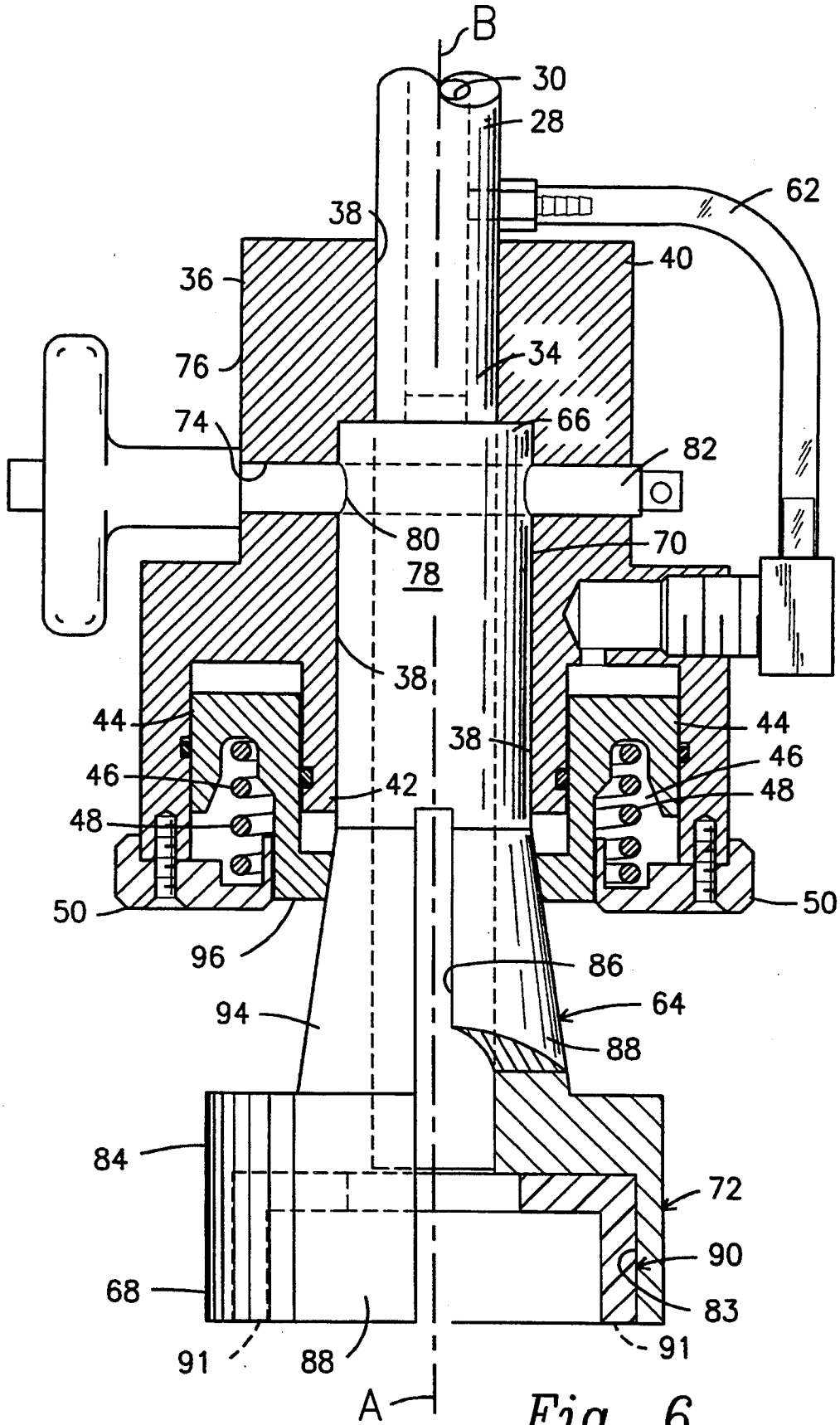
FIG. 6 is a detailed fragmentary elevational view of the apparatus of FIG. 4 shown in larger scale.

The spindle assembly 20 can be most clearly seen in FIG. 5 and is comprised of a spindle assembly support 22 that is slidably attached to the support frame 18 by a pair of bearings 24, which in this embodiment are well known linear "V"-slide bearings. A pneumatic friction clutch 26 similar to Horton Model No. 054-0496, is held within the spindle assembly support 22. A spindle 28 having an axis B enters the pneumatic clutch 26 so that its axis B generally coincides with axis A and when it exits from the bottom of the clutch 26 also generally coinciding with axis A as seen in FIG. 4. As seen most clearly in FIGS. 5 and 6, the spindle 28 has a bore 30 therethrough which is open at the first end 32 of the spindle 28 and closed at the second end 34. The open first end 32 of the spindle 28 is connected in fluid flow communication with a source of pressurized fluid, conveniently a standard air compressor shown schematically as 35 in FIG. 1. The second end 34 of the spindle 28 is attached to a collet housing 36, as shown in FIG. 6. The collet housing 36 has a longitudinal bore 38 extending therethrough from the first end 40 to the second end 42. Within the collet housing proximal the second end 42 is a piston 44 that is biased toward the first end 40. In this embodiment, the piston 44 is formed as an annular ring with an annular recess 46 formed therein that houses the biasing means, conveniently spring 48. The spring 48 is held within the recess 46 by plate 50. The pressurized fluid, in this embodiment compressed air, is passed through the hollow column 54, which is a part of the support frame 18, through a manifold 56, through a hose 58 that is connected to the first end of the spindle 28 by rotatable coupler 60. The second end 34 of the hollow spindle is closed, therefore a means is provided for connecting the bore 30 in fluid flow communication with the collet housing 36, conveniently a conventional connector 62.

A collet 64 having a first end 66 and a second end 68 is comprised of a shaft portion 70 that includes the first end 66 and a cup shaped member 72 that includes the second end 68. The first end 66 of the collet is received by a portion of the bore 38 of the collet housing 36 that includes the second end 42 of the collet housing 36. The collet housing 36 has a transverse bore 74 that extends from the exterior surface 76 of the collet housing 36 generally radially inwardly so that the transverse bore 74 at least communicates with the longitudinal bore 38. In this embodiment the transverse bore 74 extends through the collet housing 36. The collet 64 has an exterior surface 78. The shaft portion 70 of the collet 64 has a hole 80 that extends transversely inwardly from the exterior surface 78 and extends at least partially therethrough. In this embodiment the hole 80 extends through the shaft portion 70 so that it is aligned with the transverse bore 74 when the collet 64 is inserted within the collet housing 36. A pin 82 is inserted into the transverse bore 74 and through the hole 80 in the shaft portion 70 so that the collet 64 is releasably attached to the collet housing 36.

The cup shaped member 72 comprises an interior surface 83 and a peripheral edge 84. At least one slot 86, best seen in FIG. 5, extends radially inwardly from the peripheral edge 84 of the collet 64 to the shaft portion 70. In this embodiment four slots 86 are provided; however, the number of slots 86 formed therein depends upon the circumferential size of the cup shaped member 72. The plurality of slots 86 create a plurality of fingers 88. Cup shaped members 72 may be made in different sizes and shapes to fit the various sizes and shapes of caps 92.

By using inserts 90 of various sizes and shapes, the cup shaped member 72 of collet 64 may be adapted to fit a range of cap sizes. An insert 90, as shown in FIG. 6, is a broken annular ring with a right cross section comprising the form of a right angle. The insert is attached to the interior surface 83 of the cup shaped member 72. The insert 90 in this embodiment comprises a plurality of parts 91, that are sized to fit a respective finger 88 so that the insert 90 does not extend across any portion of the slots 86, which would interfere with the movement of the fingers 88. The insert 90 may be made in shapes other than the cross section of a right angle so that each size of collet 64 may be used with caps 92 having many different shapes. The inserts 90 enables one size of collet 64 to be modified in order to grip a broad range of sizes and shapes of caps 92.

The collet 64 intermediate the shaft portion 70 and the cup shaped member 72 flares outwardly from the shaft portion 70 to the cup shaped portion 72 creating a sloped portion 94. When compressed air enters the collet housing 36 it moves the piston 44 downwardly and outwardly from the second end 42 of the collet housing 36. A projection 96 is attached to the piston 44 so that the projection 96 engages the sloped portion 94 of the collet 64 causing the sloped portion 94 and the fingers 88 to move inwardly from an open position to a closed position. The open position is defined as the position of the fingers 88 when the sloped portion 94 is not engaged by the projection 96. The closed position is defined as the position of the fingers 88 when gripping a cap 92.

The weight of the spindle assembly 20 provides a downward force generally parallel to the spindle assembly axis A. The means for controlling the vertical movement of the spindle assembly 20 is shown generally as 98 in FIGS. 3, 4 and 5. The means for controlling the vertical movement 98 controls movement both upwardly and downwardly parallel to the spindle assembly axis A. The controlling means 98 comprises an arm 100 that has a first end 104 and a second end 106, the first end 104 being pivotally attached to a post 102 and the second end 106 engaging a biasing means 108. A cam follower 110 is attached to the arm 100, spaced apart from the first end 104. The cam follower 110 projects outwardly from the arm so that it engages the top surface 112 of a cam 114 that is fixed to the support frame 118. The top surface 112 of the cam 114 has a varying vertical elevation in relation to a fixed point on the support frame 118. In this embodiment, the cam 114 remains fixed while each station 12 of the turret assembly 10 rotates about the cam 114 causing the cam follower 110 to move along the top surface 112.

Figure 7:
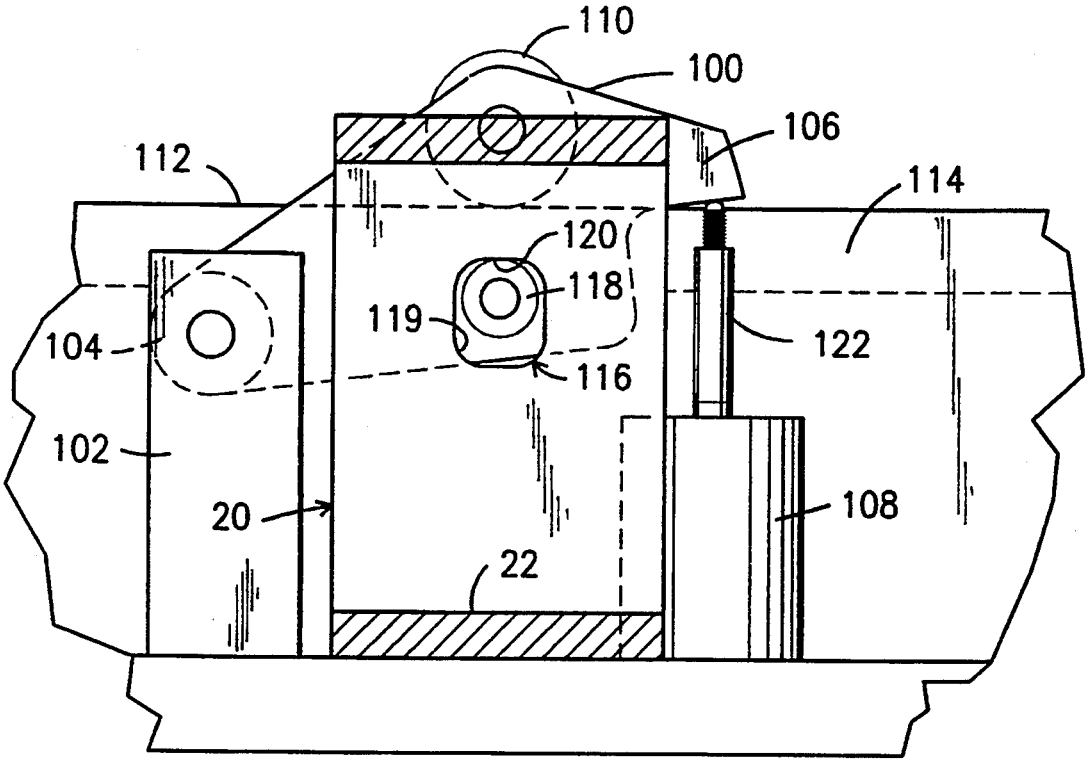
FIG. 7 is a detailed fragmentary section view taken along line 7—7 of FIG. 3 shown in larger scale.
Figure 8:
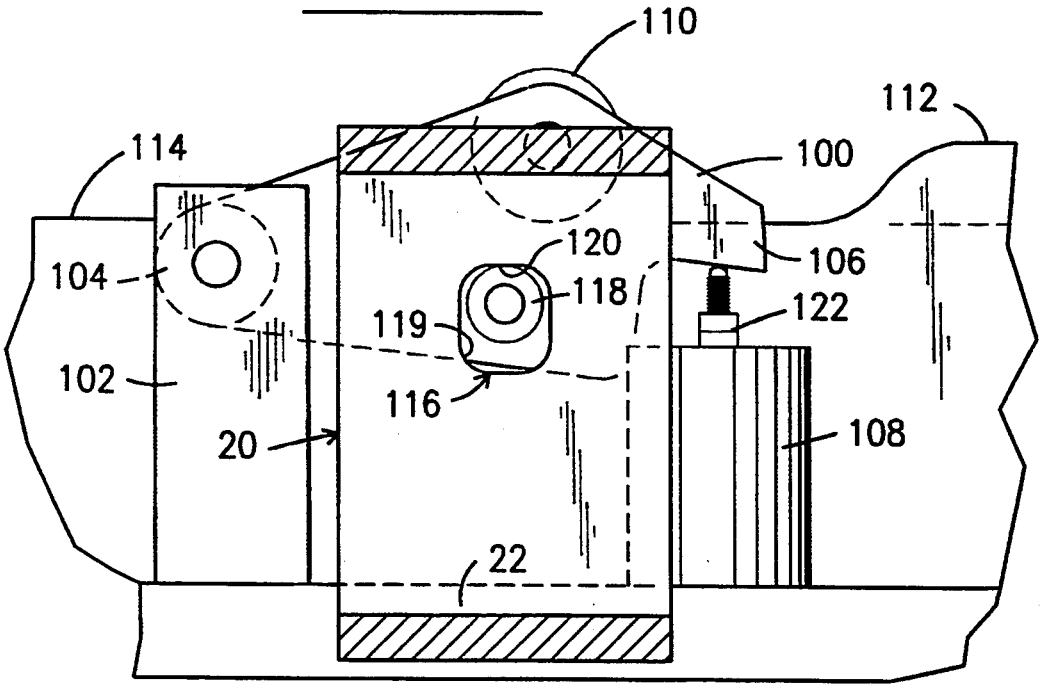
FIG. 8 is a detailed fragmentary cross sectional view taken along line 8—8 of FIG. 3 shown in larger scale.

As seen in FIGS. 7 and 8 the controlling means 98 further comprises a means for connecting the spindle assembly 20 to the arm 100 for vertical movement of the spindle assembly 20, shown generally as 115. The connecting means 115 comprises a receiver 116 and an extension 118. The receiver 116 in this embodiment comprises an aperture 119 extending through the spindle assembly support 22. In other embodiments, the receiver may be an indent, a ridge or other structure for engaging extension 118. The extension 118 is attached to the arm 100 spaced apart from the first end 104 so that the extension 118 is received within the receiver 116. The receiver 116 is sufficiently large so that the rotational movement of the arm 100 about its first end 104 is translated into primarily vertical movement of the spindle assembly support 22 and thus the spindle assembly 20. Therefore, as the cam follower 110 traces the elevation of the cam 114 the weight of the spindle assembly 20 causes the extension 118 to maintain contact with the upper surface 120 of the receiver 116 so that the changes in elevation of the cam 114 translate to changes in the upward and downward movement of the spindle assembly 20.

The biasing means 108 comprises an air spring well known in the art similar to that manufactured by FABCO, Model No. TI-7-X. The air spring 108 is attached to the support frame 18 so that the air spring shaft 122 that extends from the air spring 108 engages the second end 106 of the arm 100. The air spring 108 is attached to a regulator 124 which is connected in fluid flow relation to the manifold 56 to provide compressed air to the air spring 118. The air spring 108 is adjusted to counterbalance the majority of the weight of the spindle assembly 20 by resiliently urging the arm 100 upwardly and thus urging the spindle assembly upwardly. By selective adjustment of the air regulator 124 the upward force applied to the second end 106 of the arm 100 may be easily adjusted to provide the optimum downward force for proper operation of the capping machine 10.

As seen in FIGS. 1, 4 and 5, each spindle assembly 20 is attached to a spindle drive motor 126 that is attached to the support frame 18. The spindle assembly drive motor 126 is connected to the spindle 28 for rotational movement of the spindle 28 about its axis B by a first gear 128 and a second gear 130. The first gear 128 is attached to the spindle drive motor 126 and the second gear 130 is attached to the spindle 28. The first gear 128 and the second gear 130 engage one another for transmission of the rotational movement from the drive motor 126 to the spindle 28; however, as the spindle assembly 20 is free to move vertically parallel to the spindle assembly axis A, the second gear 130 must have sufficient longitudinal length to maintain engagement with the first gear 128 as the spindle assembly 20, with first gear 128 attached, moves upwardly or downwardly.

In a preferred embodiment most parts of the apparatus 10 are made from carbon steel; however, any well-known material suitable for the purpose may be used. The insert 90 is preferably molded from polyurethane, but other materials may be used successfully.

Now that the apparatus has been described, the method of operation of the present invention will be described as it relates to a turret assembly 10 that incorporates the present invention. As each station of the eight station turret assembly 10 illustrated in FIG. 3 incorporates the apparatus of the invention, we will focus on a single station. At the beginning of a cycle of operation, a cap feeder (not shown), of a type well known in the art, similar to applicant's hopper, elevator and bowl cap feeder, delivers a cap 92, having a longitudinal axis C to a position adjacent to the collet 64 of the spindle assembly 20 so that the axis C of the cap 92 is generally aligned with the longitudinal axis A of the spindle assembly. As the turret assembly 10 rotates the cam 114 permits the spindle assembly 20 to move downwardly so that the cap 92 is received within the cup shaped member 72 of the collet 64. Compressed air is then permitted to flow into the collet housing 36 moving the piston 44 downwardly so that the projection 96 engages the sloped portion 94 of the collet 64 causing the fingers 88 to move inwardly so that the insert 90 grips the cap 92. The spindle assembly is then raised by the cam 114 taking the cap 92 from the cap feeder (not shown).

A container 14 is moved by the means for advancing 16 into alignment with the spindle assembly 20. When in alignment, the longitudinal axis D of the container 14 generally coincides with the axis C of the cap 92 and the axis A of the spindle assembly 20. When the container 14 and the cap 92 are aligned with one another, the cam follower 110, following the top surface 112 of the cam 114, moves downwardly to a lower elevation as is shown in FIGS. 7 and 8. As the cam follower 110 moves downwardly, the arm 100 and the attached extension 118 also move downwardly permitting the receiver 116 and the spindle assembly 20 to move downwardly. When the spindle assembly 28 moves downwardly, the cap 92 held by the collet 64 engages the open end of the container 14. The interior of the cap has threads 132 thereon and the exterior of the container adjacent the open end also has threads 134 thereon for engagement with the threads 132 of the cap 92. If the full weight of the spindle assembly 20 were transmitted to the threads 132 and 134, increased torque would be necessary to thread the cap 92 on the container 14 due to frictional resistance. The downward pressure on the container threads 134, the upward pressure on the cap threads 132, and the resulting friction can damage the threads, particularly if the container threads 134 or the cap threads 132 are made from flexible plastic or other relatively fragile materials. Such damage to the threads can cause cross threading and result in failure of the cap 92 to properly close. Therefore, air spring 108, is used to provide an upward force on the second end 106 of the arm 100 to counterbalance a large portion of the downward force caused by the weight of the spindle assembly 20. By being selectively adjustable, the air spring 108 may apply the exact amount of counterbalancing force necessary to permit very little resistance between the cap threads 132 and the container threads 134 as the cap 92 is rotated on the container 14. The air spring 108 may be adjusted for different coarseness of threads and different container sizes. A column of air contained within the tube 136 joining the air regulator 124 with the air spring 108 may be adjusted by lengthening or shortening the tube 136. By controlling the volume of air between the air spring 108 and the air regulator 124 the compressibility of the air column may be controlled. The greater the volume of air the greater the compression and the greater the dampening effect of the air spring 108. Dampening lessens the impact caused by abrupt changes in movement of the spindle assembly 20 lessening the risk of damage to the container 14. The column of air contained within the tube 136 helps adjust the compressibility of the air spring providing a more cushioned or resilient movement of the spindle assembly 20.

Now the cap 92 may be rotated upon the container 14 with little frictional resistance between the cap threads 132 of the cap 92 and the threads 134 of the container 14. The cap 92 is rotated upon the container 14 by rotation of the spindle 28 and operation of the pneumatic friction clutch 26, techniques well known in the art. The hollow spindle 28 provides a direct means for providing compressed air to the collet housing 36. The remaining operations of the turret assembly 10 are old and well known in the art.

While the foregoing description is directed to particularly preferred embodiments of the present invention, it is to be understood that these embodiments are representative only of the principles of the invention are not to be considered limitative thereof. Because numerous variations and modifications of the apparatus, all within the scope of the present invention, will become apparent to those skilled in the art, the scope of the invention is to be limited solely by the claims appended hereto.

What is claimed is:

1. Apparatus for rotating cylindrical, downward facing threaded caps onto upwardly facing, threaded open ends of containers, comprising;

a support frame;

at least one spindle assembly having a generally vertical axis and being slidably carried by said support frame for movement generally parallel to said vertical axis, said spindle assembly including a collet that captures said cap for placement on said container, said cap having a generally vertical axis;

means positioned adjacent said support frame for advancing said container along a predetermined path, said container having a generally vertical axis and continuing said advancing until said axis of said container is generally aligned with said axis of said cap;

means carried by said support frame for controlling vertical movement of said spindle assembly caused by the weight of said spindle, assembly comprising;

a selectively adjustable biasing means carried by said support frame for resiliently urging said spindle assembly upwardly parallel to said spindle axis, such that an upward force created by said biasing means at least partially supports said weight of said spindle assembly, whereby the container is engaged by the cap held by the collet with less than the full weight of the spindle assembly;

an arm having a first end pivotally connected to said support frame and a second end engaging said biasing means for application of said upward force to said arm for rotation about said first end of said arm; and means for connecting said arm to said spindle assembly for imparting generally vertical motion to said spindle assembly whereby the container is engaged by the cap held by the collet with less than the full weight of the spindle assembly; and means for rotating said collet when said cap is brought into engagement with said container whereby said cap threadably engages said open end of said container.

2. The apparatus of claim 1 wherein said spindle assembly further comprises a spindle assembly support attached to said spindle assembly and slideably connected to said support frame and wherein said means for connecting said arm to said spindle assembly comprises a receiver formed in said spindle assembly support adjacent said arm; and an extension attached to said arm spaced apart from said first end of said arm, a portion of said extension being received by said receiver.

3. The apparatus of claim 1 wherein said means for controlling said vertical movement of said spindle assembly further comprises a cam mounted on said support frame, said cam having a top surface with a varying vertical elevation in relation to a fixed point on said support frame;

a cam follower attached to said arm, spaced apart from said first end of said arm, for engagement of said top surface of said cam; and a means for moving said cam and said cam surface in relation to one another for upward and downward movement of said second end of said arm and said spindle assembly engaged with said arm.

4. Apparatus for rotating cylindrical, downward facing threaded caps onto upwardly facing, threaded open ends of containers, comprising a support frame;

at least one spindle assembly having a generally vertical axis and being slidably carried by said support frame for movement generally parallel to said vertical axis, said spindle assembly comprising;

a spindle having a first end and a second end;

a collet housing having a longitudinal bore extending therethrough and an exterior surface, said collet housing having a first end and a second end, said first end being attached to said second end of said spindle and said collet housing having a bore extending generally transverse of said longitudinal bore extending from said exterior surface radially inwardly to at least communicate with said longitudinal bore;

a collet having a first end and a second end, said first end of said collet comprising a shaft having an exterior surface, said shaft being received at said second end of said collet housing by a portion of said longitudinal bore, said shaft having a hole extending transversely inwardly of said surface and extending at least partially therethrough such that said hole in said shaft aligns with said transverse bore in said collet housing; and a pin removably insertable into said horizontal bore of said collet housing and said hole in said shaft of said collet, whereby said collet is releasably attached to said collet housing;

means positioned adjacent said support frame for advancing said container along a predetermined path, said container having a generally vertical axis and continuing said advancing until said axis of said container is generally aligned with said axis of said cap;

means carried by said support frame for controlling (said) vertical movement of said spindle assembly caused by the weight of said spindle assembly comprising a selectively adjustable biasing means carried by said support frame for resiliently urging said spindle assembly upwardly parallel to said spindle axis, such that upward force created by said biasing means at least partially supports said weight of said spindle assembly, whereby the container is engaged by the cap held by the collet with less than the full weight of the spindle assembly; and means for rotating said collet when said cap is brought into engagement with said container whereby said cap threadably engages said open end of said container.

5. Apparatus for rotating cylindrical, downwardly facing threaded caps onto upwardly facing, threaded open ends of containers, comprising:

a support frame;

at least one spindle assembly having a generally vertical axis and being slideably carried by said support frame for movement generally parallel to said vertical axis, said spindle assembly including a collet that captures a cap for placement on said container, said cap having a generally vertical axis, said spindle assembly further comprising;

a spindle having a first end and a second end and a bore therethrough, the first end of said spindle bore being open and the second end of said bore of said spindle being closed;;

a collet housing having a longitudinal bore extending therethrough, said collet housing having a first end and a second end, said first end being attached to said second end of said spindle, said collet housing comprising a piston therein for movement generally parallel to said longitudinal bore;

a collet having a first end and a second end, said first end of said collet comprising a shaft received at said second end of said collet housing by a portion of said longitudinal bore, said second end of said collet comprising said portion of said spindle assembly contacting said cap;

a source of pressurized fluid attached in fluid flow communication with said first end of said spindle; and a means for connecting said bore of said spindle in fluid flow communication with said collet housing for movement of said piston into engagement with said collet by the pressurized fluid, said piston moving said collet to a closed position, defined as the position when said collet grips said cap;

means positioned adjacent said support frame for advancing said container along a predetermined path, said container having a generally vertical axis and continuing said advancing until said axis of said container is generally aligned with said axis of said cap;

means carried by said support frame for controlling (said) vertical movement of said spindle assembly caused by the weight of said spindle assembly comprising a selectively adjustable biasing means carried by said support frame for resiliently urging said spindle assembly upwardly parallel to said spindle axis, such that upward force created by said biasing means at least partially supports said weight of said spindle assembly, whereby the container is engaged by the cap held by the collet with less than the full weight of the spindle assembly; and means for rotating said collet when said cap is brought into engagement with said container whereby said cap threadably engages said open end of said container.

6. The apparatus of claim 5 wherein said second end of said collet comprises an inverted cup shaped member having an interior surface, a peripheral edge and at least one slot through said member extending radially inwardly from said peripheral edge;

a collet insert comprising at least one part attached to said interior surface of said cup shaped member, said insert sized and configured to grip said cap when said collet is in said closed position.

* * * * *